US009079321B2

(12) United States Patent
Claus et al.

(10) Patent No.: US 9,079,321 B2
(45) Date of Patent: Jul. 14, 2015

(54) RAZOR BLADES

(75) Inventors: Oliver H. Claus, Walpole, MA (US); Joseph Allan DePuydt, Scituate, MA (US); Steve S. Hahn, Wellesley, MA (US); Yongqing Ju, Medfield, MA (US); John Madeira, Assonet, MA (US); Krassimir Grigorov Marchev, Sudbury, MA (US); Kenneth James Skrobis, Maynard, MA (US); Neville Sonnenberg, Newton, MA (US); Charles Samuel White, Lynnfield, MA (US)

(73) Assignee: The Gillette Company, Boston, MA (US)

( * ) Notice: Subject to any disclaimer, the term of this patent is extended or adjusted under 35 U.S.C. 154(b) by 1409 days.

(21) Appl. No.: 12/174,058

(22) Filed: Jul. 16, 2008

(65) Prior Publication Data

US 2010/0011595 A1 Jan. 21, 2010

(51) Int. Cl.

| | |
|---|---|
| ***B26B 21/56*** | (2006.01) |
| ***B26B 21/60*** | (2006.01) |
| *B26B 21/58* | (2006.01) |

(52) U.S. Cl.

CPC ..... *B26B 21/56* (2013.01); *B26B 21/60* (2013.01); *B26B 21/58* (2013.01)

(58) Field of Classification Search

USPC ..... 30/346.54, 346.55, 346.53, 346.5, 350, 30/357

See application file for complete search history.

(56) References Cited

U.S. PATENT DOCUMENTS

| | | | | |
|---|---|---|---|---|
| 3,835,537 | A * | 9/1974 | Sastri | 30/346.53 |
| 3,861,040 | A | 1/1975 | Dorion, Jr. | |
| 4,720,918 | A * | 1/1988 | Curry et al. | 30/346.55 |
| 4,916,817 | A | 4/1990 | Atwater | |
| 5,048,191 | A | 9/1991 | Hahn | |
| 5,056,227 | A | 10/1991 | Kramer | |
| 5,121,660 | A | 6/1992 | Kramer | |
| 5,275,672 | A * | 1/1994 | Althaus et al. | 148/325 |
| 5,497,550 | A | 3/1996 | Trotta et al. | |
| 5,669,144 | A | 9/1997 | Hahn et al. | |

(Continued)

FOREIGN PATENT DOCUMENTS

| | | |
|---|---|---|
| EP | 1 287 953 A1 | 3/2003 |
| GB | 1 465 697 | 2/1977 |
| WO | WO 02/100610 A1 | 12/2002 |

OTHER PUBLICATIONS

PCT International Search Report with Written Opinion in corresponding Int'l appln. PCT/US2009/049906 dated Oct. 12, 2009.

*Primary Examiner* — Omar Flores Sanchez

(74) *Attorney, Agent, or Firm* — Joanne N. Pappas; Kevin C. Johnson; Steven W. Miller

(57) ABSTRACT

A razor blade having a substrate with a cutting edge being defined by a sharpened tip. The substrate has a thickness of between about 1.3 and 1.6 micrometers measured at a distance of four micrometers from the blade tip, a thickness of between about 2.2 and 2.7 micrometers measured at a distance of eight micrometers from the blade tip, a thickness of between about 3.8 and 4.9 micrometers measured at a distance of sixteen micrometers from the blade tip, a ratio of thickness measured at four micrometers from the blade tip to the thickness measured at eight micrometers from the blade tip of at least 0.55 and a ratio of thickness measured at four micrometers from the blade tip to the thickness measured at sixteen micrometers from the blade tip of at least 0.30.

12 Claims, 2 Drawing Sheets

(56) References Cited

U.S. PATENT DOCUMENTS

| | | | | |
|---|---|---|---|---|
| 5,795,648 | A * | 8/1998 | Goel et al. | 428/336 |
| 5,799,549 | A | 9/1998 | Decker et al. | |
| 6,684,513 | B1 | 2/2004 | Clipstone et al. | |
| 7,060,367 | B2 * | 6/2006 | Yamada et al. | 428/634 |
| 7,140,113 | B2 * | 11/2006 | King et al. | 30/346.54 |
| 7,587,829 | B2 * | 9/2009 | King et al. | 30/346.54 |
| 2004/0177516 | A1 | 9/2004 | Teeuw et al. | |

* cited by examiner

RAZOR BLADES

TECHNICAL FIELD

This invention relates to razors and more particularly to razor blades with sharp and durable cutting edges.

BACKGROUND

A razor blade is typically formed of a suitable substrate material such as stainless steel, and a cutting edge is formed with a wedge-shaped configuration with an ultimate tip having a radius. Hard coatings such as diamond, amorphous diamond, diamond-like carbon-(DLC) material, nitrides, carbides, oxides or ceramics are often used to improve strength, corrosion resistance and shaving ability, maintaining needed strength while permitting thinner edges with lower cutting forces to be used. Polytetrafluoroethylene (PTFE) outer layer can be used to provide friction reduction. Interlayers of niobium or chromium containing materials can aid in improving the binding between the substrate, typically stainless steel, and hard carbon coatings, such as DLC.

It is desirable to improve the shape of the razor blade substrate to reduce the cutter force needed to cut hair. Such a reduction in cutter force will lead to a more comfortable shave.

SUMMARY

The present invention provides a razor blade comprising a substrate. The substrate has a cutting edge being defined by a sharpened tip. The substrate has a thickness of between about 1.3 and 1.6 micrometers measured at a distance of four micrometers from the blade tip, a thickness of between about 2.2 and 2.7 micrometers measured at a distance of eight micrometers from the blade tip, a thickness of between about 3.8 and 4.9 micrometers measured at a distance of sixteen micrometers from the blade tip, a ratio of thickness measured at four micrometers from the tip to the thickness measured at eight micrometers from the tip of at least 0.55 and a ratio of thickness measured at four micrometers from the tip to the thickness measured at sixteen micrometers from the tip of at least 0.30.

Preferably, the substrate has a tip radius of from about 125 to 300 angstroms.

The razor blade may comprise an interlayer joined to the substrate. The interlayer preferably comprises niobium.

The razor blade may comprise a coating layer joined to the interlayer. The coating layer preferably comprises a partially amorphous material containing carbon.

The razor blade may comprise an overcoat layer joined to the coating layer. The overcoat layer preferably comprises chromium.

The razor blade may comprise an outer layer joined to the overcoat layer. The outer layer preferably comprises a polymer. The outer layer may comprise polytetrafluoroethylene.

DESCRIPTION OF DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION

Figure 1:
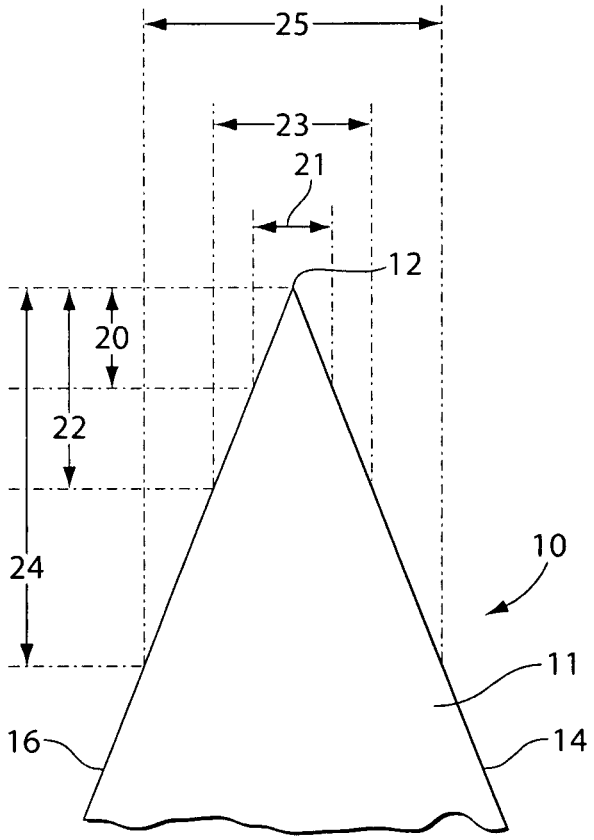
FIG. 1 is a diagrammatic view illustrating a blade substrate.

Referring now to FIG. 1, there is shown a razor blade 10. The razor blade 10 includes stainless steel body portion or substrate 11 with a wedge-shaped sharpened edge having a tip 12. Tip 12 preferably has a radius of from about 125 to 300 angstroms with facets 14 and 16 that diverge from tip 12. The substrate 11 has a thickness 21 of between about 1.3 and 1.6 micrometers measured at a distance 20 of four micrometers from the blade tip 12. The substrate 11 has a thickness 23 of between about 2.2 and 2.7 micrometers measured at a distance 22 of eight micrometers from the blade tip 12. The substrate 11 has a thickness 25 of between about 3.8 and 4.9 micrometers measured at a distance 24 of sixteen micrometers from the blade tip 12.

The substrate 11 has a ratio of thickness 21 measured at four micrometers from the tip 12 to the thickness 23 measured at eight micrometers from the tip 12 of at least 0.55. The substrate 11 has a ratio of thickness 21 measured at four micrometers from the tip 12 to the thickness 25 measured at sixteen micrometers from the tip 12 of at least 0.30.

The thicknesses and ratios of thicknesses provide a framework for improved shaving. The thicknesses and ratios of thickness provide a balance between edge strength and low cutting force or sharpness. A substrate having smaller ratios will have inadequate strength leading to ultimate edge failure. A substrate having greater thicknesses will have a higher cutting force leading to an increased tug and pull and increased discomfort for the user during shaving.

One substrate 11 material which may facilitate producing an appropriately sharpened edge is a martensitic stainless steel with smaller more finely distributed carbides, but with similar overall carbon weight percent. A fine carbide substrate provides for a harder and more brittle after-hardening substrates, and enables the making of a thinner, stronger edge. An example of such a substrate material is a martensitic stainless steel with a finer average carbide size with a carbide density of at least about 200 carbides per square micrometer, more preferably at least about 300 carbides per square micrometer and most preferably at least about 400 carbides or more per 100 square micrometers as determined by optical microscopic cross-section.

Figure 2:
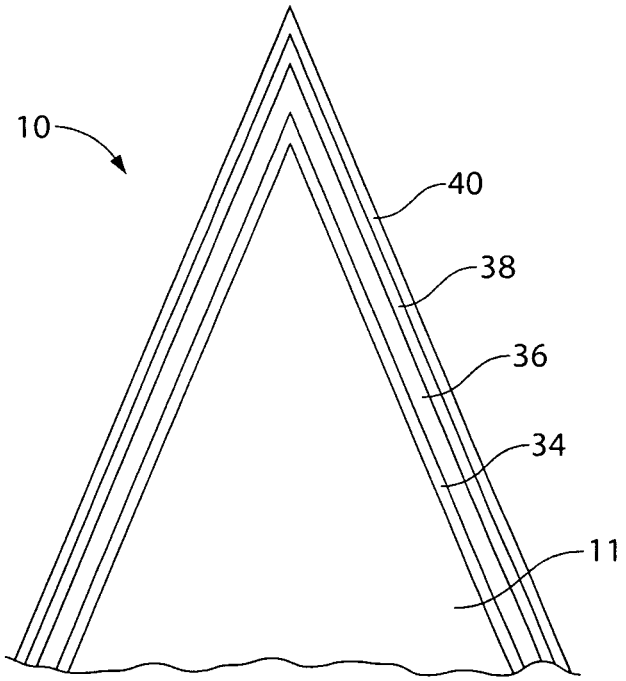
FIG. 2 is a diagrammatic view illustrating a razor blade.

Referring now to FIG. 2, there is shown a finished first blade 10 including substrate 11, interlayer 34, hard coating layer 36, overcoat layer 38, and outer layer 40. The substrate 11 is typically made of stainless steel though other materials can be employed. An example of a razor blade having a substrate, interlayer, hard coating layer, overcoat layer and outer layer is described in U.S. Pat. No. 6,684,513.

Interlayer 34 is used to facilitate bonding of the hard coating layer 36 to the substrate 11. Examples of suitable interlayer material are niobium, titanium and chromium containing material. A particular interlayer is made of niobium greater than about 100 angstroms and preferably less than about 500 angstroms thick. The interlayer may have a thickness from about 150 angstroms to about 350 angstroms. PCT 92/03330 describes use of a niobium interlayer.

Hard coating layer 36 provides improved strength, corrosion resistance and shaving ability and can be made from fine-, micro-, or nano-crystalline carbon-containing materials (e.g., diamond, amorphous diamond or DLC), nitrides (e.g., boron nitride, niobium nitride, chromium nitride, zirconium nitride, or titanium nitride), carbides (e.g., silicon carbide), oxides (e.g., alumina, zirconia) or other ceramic materials (including nanolayers or nanocomposites). The carbon containing materials can be doped with other elements, such as tungsten, titanium, silver, or chromium by including these additives, for example in the target during application by sputtering. The materials can also incorporate hydrogen, e.g., hydrogenated DLC. Preferably coating layer 36 is made of diamond, amorphous diamond or DLC. A particular embodiment includes DLC less than about 3,000 angstroms, preferably from about 500 angstroms to about 1,500 angstroms. DLC layers and methods of deposition are described in U.S. Pat. No. 5,232,568. As described in the "Handbook of Physical Vapor Deposition (PVD) Processing," "DLC is an amorphous carbon material that exhibits many of the desirable properties of diamond but does not have the crystalline structure of diamond."

Overcoat layer 38 is used to reduce the tip rounding of the hard coated edge and to facilitate bonding of the outer layer to the hard coating while still maintaining the benefits of both. Overcoat layer 38 is preferably made of chromium containing material, e.g., chromium or chromium alloys or chromium compounds that are compatible with polytetrafluoroethylene, e.g., CrPt. A particular overcoat layer is chromium about 100-200 angstroms thick. Overcoat layer may have a thickness of from about 50 angstroms to about 500 angstroms, preferably from about 100 angstroms to about 300 angstroms. Razor blade 10 has a cutting edge that has less rounding with repeated shaves than it would have without the overcoat layer.

Outer layer 40 is used to provide reduced friction. The outer layer 40 may be a polymer composition or a modified polymer composition. The polymer composition may be polyfluorocarbon. A suitable polyfluorocarbon is polytetrafluoroethylene sometimes referred to as a telomer. A particular polytetrafluoroethylene material is Krytox LW 1200 available from DuPont. This material is a nonflammable and stable dry lubricant that consists of small particles that yield stable dispersions. It is furnished as an aqueous dispersion of 20% solids by weight and can be applied by dipping, spraying, or brushing, and can thereafter be air dried or melt coated. The layer is preferably less than 5,000 angstroms and could typically be 1,500 angstroms to 4,000 angstroms, and can be as thin as 100 angstroms, provided that a continuous coating is maintained. Provided that a continuous coating is achieved, reduced telomer coating thickness can provide improved first shave results. U.S. Pat. Nos. 5,263,256 and 5,985,459, which are hereby incorporated by reference, describe techniques which can be used to reduce the thickness of an applied telomer layer.

Razor blade 10 is made generally according to the processes described in the above referenced patents. A particular embodiment includes a niobium interlayer 34, DLC hard coating layer 36, chromium overcoat layer 38, and Krytox LW1200 polytetrafluoroethylene outer coat layer 40. Chromium overcoat layer 38 is deposited to a minimum of 100 angstroms and a maximum of 500 angstroms. It is deposited by sputtering using a DC bias (more negative than −50 volts and preferably more negative than −200 volts) and pressure of about 2 millitorr argon. The increased negative bias is believed to promote a compressive stress (as opposed to a tensile stress), in the chromium overcoat layer which is believed to promote improved resistance to tip rounding while maintaining good shaving performance. Razor blade 10 preferably has a tip radius of about 200-400 angstroms, measured by SEM after application of overcoat layer 38 and before adding outer layer 40.

The substrate profile of the razor blade of the present invention provides an improvement in blade sharpness. The blade sharpness may be quantified by measuring cutter force, which correlates with sharpness. Cutter force is measured by the wool felt cutter test, which measures the cutter forces of the blade by measuring the force required by each blade to cut through wool felt. The cutter force of each blade is determined by measuring the force required by each blade to cut through wool felt. Each blade is run through the wool felt cutter 5 times and the force of each cut is measured on a recorder. The lowest of 5 cuts is defined as the cutter force.

The finished blade 10 has cutter force of less than about 1.10 lbs, preferably less than about 1.05 lbs. This is considered herein to be a relatively sharp blade.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor blade comprising:

a stainless steel substrate with a cutting edge being defined by a sharpened tip, said substrate having a thickness of between about 1.3 and 1.6 micrometers measured at a distance of four micrometers from the blade tip, a thickness of between about 2.2 and 2.7 micrometers measured at a distance of eight micrometers from the blade tip, a thickness of between about 3.8 and 4.9 micrometers measured at a distance of sixteen micrometers from the blade tip, a ratio of thickness measured at four micrometers to the thickness measured at eight micrometers of at least 0.55 and a ratio of thickness measured at four micrometers to the thickness measured at sixteen micrometers of at least 0.30.

2. The razor blade of claim 1, wherein the substrate is a martensitic stainless steel having a carbide density of at least about 200 carbides or more per 100 square micrometers as determined by optical microscopic cross-section.

3. The razor blade of claim 1, wherein the substrate has a tip radius of from about 125 to 300 angstroms.

4. The razor blade of claim 1 further comprising an interlayer joined to said substrate.

5. The razor blade of claim 3 wherein said interlayer comprises niobium.

6. The razor blade of claim 3, further comprising a coating layer joined to said interlayer.

7. The razor blade of claim 5 wherein said coating layer comprises an amorphous material containing carbon.

8. The razor blade of claim 5 further comprising an overcoat layer joined to said coating layer.

9. The razor blade of claim 7 wherein said overcoat layer comprises chromium.

10. The razor blade of claim 7 further comprising an outer layer joined to said overcoat layer.

11. The razor blade of claim 9 wherein said outer layer comprises a polymer.

12. The razor blade of claim 9 wherein said outer layer comprises polytetrafluoroethylene.

* * * * *